US008399164B2

(12) United States Patent
Wu

(10) Patent No.: US 8,399,164 B2
(45) Date of Patent: Mar. 19, 2013

(54) DENDRITIC POLYESTER POLYOL PHOTOCONDUCTORS

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 12/768,873

(22) Filed: Apr. 28, 2010

(65) Prior Publication Data

US 2011/0269064 A1 Nov. 3, 2011

(51) Int. Cl.
*G03G 5/14* (2006.01)

(52) U.S. Cl. ..... 430/58.8; 430/60; 430/63; 430/65; 430/58.75

(58) Field of Classification Search ..... 430/58.8, 430/58.75, 60, 63, 65
See application file for complete search history.

(56) References Cited

U.S. PATENT DOCUMENTS

| | | | | |
|---|---|---|---|---|
| 4,298,697 | A | 11/1981 | Baczek et al. | |
| 4,338,390 | A | 7/1982 | Lu | |
| 4,464,450 | A | 8/1984 | Teuscher | |
| 4,560,635 | A | 12/1985 | Hoffend et al. | |
| 5,385,796 | A | 1/1995 | Spiewak et al. | |
| 5,449,573 | A | 9/1995 | Aoki et al. | |
| 5,928,824 | A | 7/1999 | Obinata et al. | |
| 6,156,468 | A | 12/2000 | Wehelie et al. | |
| 6,177,219 | B1 | 1/2001 | Yuh et al. | |
| 6,207,334 | B1 | 3/2001 | Dinh et al. | |
| 6,255,027 | B1 | 7/2001 | Wehelie et al. | |
| 6,913,863 | B2 | 7/2005 | Wu et al. | |
| 7,312,007 | B2 | 12/2007 | Lin et al. | |
| 7,541,123 | B2 * | 6/2009 | Mishra et al. | 430/64 |
| 7,544,452 | B2 | 6/2009 | Wu et al. | |
| 7,604,914 | B2 | 10/2009 | Lin et al. | |
| 7,670,737 | B2 | 3/2010 | Wu | |
| 2008/0032216 | A1 * | 2/2008 | Levy et al. | 430/58.8 |
| 2009/0035676 | A1 | 2/2009 | Wu | |
| 2009/0214969 | A1 * | 8/2009 | Coggan et al. | 430/58.75 |
| 2009/0246668 | A1 | 10/2009 | Wu | |

FOREIGN PATENT DOCUMENTS

EP 980027 A1 * 2/2000

OTHER PUBLICATIONS

C. Gao, D. Yan. Hyperbranched polymers: from synthesis to applications, 2004, Prog. Polym. Sci., 29, pp. 183-275.*

B. Pettersson. Hyperbranched polymers—Unique design tools for multi property control in resins and coatings, 1996, Pigment & Resin Technology, 25, pp. 4-14.*

Jin Wu., U.S. Appl. No. (not yet assigned), entitled Phenolic Glycoluril Containing Photoconductors, filed concurrently herewith.

Jin Wu et al., U.S. Appl. No. (not yet assigned), entitled Phosphate Containing Photoconductors, filed concurrently herewith.

* cited by examiner

*Primary Examiner* — Christopher Rodee
(74) *Attorney, Agent, or Firm* — Eugene O. Palazzo

(57) ABSTRACT

A photoconductor that includes, for example, a supporting substrate, an undercoat layer thereover wherein the undercoat layer contains a metal oxide a phenolic resin and a dendritic polyester polyol; a photogenerating layer; and at least one charge transport layer.

31 Claims, No Drawings

DENDRITIC POLYESTER POLYOL PHOTOCONDUCTORS

CROSS REFERENCE TO RELATED APPLICATIONS

Illustrated in copending U.S. application Ser. No. 12/768,843, U.S. Publication No. 20110269063, filed Apr. 28, 2010, and entitled Phenolic Glycoluril Containing Photoconductors, is a photoconductor comprising a substrate, an undercoat layer thereover and wherein the undercoat layer is comprised of a metal oxide and a resin mixture of a phenolic resin and a glycoluril resin; a photogenerating layer; and a charge transport layer.

Illustrated in U.S. application Ser. No. 12/768,856, now U.S. Pat. No. 8,153,341, filed Apr. 28, 2010, and entitled Phosphate Containing Photoconductors, is a photoconductor comprising a substrate, and an undercoat layer thereover comprised of a metal oxide, and a mixture of a phenolic resin and a phosphate; a photogenerating layer; and a charge transport layer.

Illustrated in U.S. application Ser. No. 12/059,536, U.S. Publication No. 20090246668, now U.S. Pat. No. 7,794,906, filed Mar. 31, 2008, entitled Carbazole Hole Blocking Layer Photoconductors, the disclosure of which is totally incorporated herein by reference, is a photoconductor that includes, for example, a substrate; an undercoat layer thereover wherein the undercoat layer contains a metal oxide and a carbazole containing compound; a photogenerating layer; and at least one charge transport layer.

The appropriate components and processes, number and sequence of the layers, component and component amounts in each layer, and the thicknesses of each layer of the above copending applications, may be selected for the present disclosure photoconductors in embodiments thereof.

BACKGROUND

There are disclosed herein hole blocking layers, and more specifically, photoconductors containing a hole blocking layer or undercoat layer (UCL) comprised, for example, of a metal oxide, such as a titanium oxide, and more specifically a titanium dioxide, $TiO_2$, dispersed in a mixture of a phenolic resin, and a dendritic or branched polyol, and which layer is coated or deposited on a first layer like a supporting substrate and/or a ground plane layer of, for example, aluminum, titanium, zirconium, gold, or a gold containing compound.

Also, in embodiments, photoconductors comprised of the disclosed hole blocking or undercoat layer enables, for example, excellent and minimum desirable ghosting characteristics; acceptable electricals and low background properties; the blocking of or minimization of the movement of holes or positive charges generated from the ground plane layer, and excellent cyclic stability, and thus color print stability especially for xerographic generated color copies. Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example about 200 kilocycles, or xerographic prints of, for example, from about 75 to about 250 kiloprints. Excellent color print stability refers, for example, to substantially no or minimal change in solid area density, especially in 45 to 60 percent halftone prints, and no or minimal random color variability from print to print after a number of xerographic prints.

Further, in embodiments the photoconductors disclosed permit the minimization or substantial elimination of undesirable ghosting on developed images, such as xerographic images, including minimal ghosting, especially as compared to a similar photoconductor, where the resin mixture disclosed herein is absent, and at various relative humidities; excellent cyclic and stable electrical properties; acceptable charge deficient spots (CDS); and compatibility with the photogenerating and charge transport resin binders, such as polycarbonates. Charge blocking layer and hole blocking layer are generally used interchangeably with the phrase "undercoat layer".

The need for excellent print quality in xerographic systems is of value, especially with the advent of color. Common print quality issues can be dependent on the components of the undercoat layer (UCL). When the undercoat layer is too thin, then incomplete coverage of the substrate may sometimes result due to wetting problems on localized unclean substrate surface areas. This incomplete coverage may produce pin holes which can, in turn, produce print defects such as charge deficient spots (CDS) and bias charge roll (BCR) leakage breakdown. Other problems include image "ghosting" resulting from, it is believed, the accumulation of charge somewhere in the photoreceptor. Removing trapped electrons and holes residing in the imaging members is a factor in preventing ghosting. During the exposure and development stages of xerographic cycles, the trapped electrons are mainly at or near the interface between the charge generation layer (CGL) and the undercoat layer (UCL), and holes are present mainly at or near the interface between the charge generation layer and the charge transport layer (CTL). The trapped charges can migrate according to the electric field during the transfer stage where the electrons can move from the interface of CGL/UCL to CTL/CGL, or the holes from CTL/CGL to CGL/UCL, and become deep traps that are no longer mobile. Consequently, when a sequential image is printed, the accumulated charge results in image density changes in the current printed image that reveals the previously printed image. Thus, there is a need to minimize or eliminate charge accumulation in photoreceptors without sacrificing the desired thickness of the undercoat layer, and a need for permitting the UCL to properly adhere to the other photoconductive layers, such as the photogenerating layer, for extended time periods, such as for example, about 750,000 simulated xerographic imaging cycles. Thus, a number of conventional materials used for the undercoat or blocking layer possess a number of disadvantages resulting in adverse print quality characteristics. For example, ghosting, charge deficient spots, and bias charge roll leakage breakdown are problems that commonly occur, and which problems are minimized with the photoconductors illustrated herein.

Thick undercoat layers are sometimes desirable for xerographic photoconductors as such layers permit photoconductor life extension and carbon fiber resistance. Furthermore, thicker undercoat layers permit the use of economical substrates in the photoreceptors. Examples of thick undercoat layers are disclosed in U.S. Pat. No. 7,312,007, however, due primarily to insufficient electron conductivity in dry and cold environments, the residual potential in conditions, such as 10 percent relative humidity and 70° F., can be high when the undercoat layer is thicker than about 15 microns, and moreover, the adhesion of the UCL may be poor, disadvantages avoided or minimized with the UCL of the present disclosure.

Also included within the scope of the present disclosure are apparatuses like xerographic copying and printing machines, and methods of imaging and printing with the photoconductors illustrated herein. These methods generally involve the formation of an electrostatic latent image on the imaging member, followed by developing the image with a toner composition comprised, for example, of a thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members, photoconductor drums, and flexible belts disclosed herein can be selected for the Xerox Corporation iGEN3® machines that generate with some versions over 100 copies per minute. Processes of imaging, especially xerographic imaging and printing, including digital, and/or high speed color printing, are thus encompassed by the present disclosure.

REFERENCES

Illustrated in U.S. Pat. No. 7,670,737, the disclosure of which is totally incorporated herein by reference, is a photoconductor comprising a substrate; an undercoat layer thereover wherein the undercoat layer comprises a metal oxide, and an ultraviolet light absorber component; a photogenerating layer; and at least one charge transport layer.

Illustrated in U.S. Pat. No. 7,544,452, the disclosure of which is totally incorporated herein by reference, are binders containing metal oxide nanoparticles and a co-resin of a phenolic resin and aminoplast resin, and an electrophotographic imaging member undercoat layer containing the binders.

Illustrated in U.S. Pat. No. 7,604,914, the disclosure of which is totally incorporated herein by reference, is an electrophotographic imaging member, comprising a substrate, an undercoat layer disposed on the substrate, wherein the undercoat layer comprises a polyol resin, an aminoplast resin, and a metal oxide dispersed therein; and at least one imaging layer formed on the undercoat layer, and wherein the polyol resin is, for example, selected from the group consisting of acrylic polyols, polyglycols, polyglycerols, and mixtures thereof.

Illustrated in U.S. Pat. No. 6,913,863 is a photoconductive imaging member comprised of an optional supporting substrate, a hole blocking layer thereover, a photogenerating layer, and a charge transport layer, and wherein the hole blocking layer is comprised of a metal oxide, and a mixture of phenolic resins, and wherein at least one of the resins contains two hydroxy groups.

Illustrated in U.S. Pat. Nos. 6,255,027; 6,177,219, and 6,156,468 are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM™, available from OxyChem Company.

Illustrated in U.S. Pat. No. 6,015,645 is a photoconductive imaging member comprised of a supporting substrate, a hole blocking layer, an optional adhesive layer, a photogenerating layer, and a charge transport layer, and wherein the blocking layer is comprised of a polyhaloalkylstyrene.

Illustrated in U.S. Pat. No. 5,473,064, the disclosure of which is totally incorporated herein by reference, is a process for the preparation of hydroxygallium phthalocyanine Type V, essentially free of chlorine.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

A number of photoconductors are disclosed in U.S. Pat. No. 5,489,496; U.S. Pat. No. 4,579,801; U.S. Pat. No. 4,518,669; U.S. Pat. No. 4,775,605; U.S. Pat. No. 5,656,407; U.S. Pat. No. 5,641,599; U.S. Pat. No. 5,344,734; U.S. Pat. No. 5,721,080; and U.S. Pat. No. 5,017,449, U.S. Pat. No. 6,200,716; U.S. Pat. No. 6,180,309, and U.S. Pat. No. 6,207,334.

A number of undercoat or charge blocking layers are disclosed in U.S. Pat. No. 4,464,450; U.S. Pat. No. 5,449,573; U.S. Pat. No. 5,385,796, and U.S. Pat. No. 5,928,824.

SUMMARY

According to embodiments illustrated herein, and wherein ghosting is minimized or substantially eliminated in images printed with, for example, xerographic imaging systems, there are provided photoconductors that enable, it is believed, acceptable print quality in systems with high transfer current; acceptable CDS characteristics as compared, for example, to a similar photoconductor where the phenolic resin and dendritic polyester polyol mixture illustrated herein is absent.

Embodiments disclosed herein also include a photoconductor comprising a substrate, a ground plane layer, and an undercoat layer as illustrated herein, and deposited on the ground plane layer, a photogenerating layer, and a charge transport layer formed on the photogenerating layer; a photoconductor comprised of a substrate, a ground plane layer, an undercoat layer deposited on the ground plane, wherein the undercoat layer comprises a metal oxide, such as $TiO_2$, dispersed in a mixture of a phenolic resin and a dendritic polyester polyol, and which photoconductors exhibited excellent electrical characteristics at time zero with no xerographic imaging cycles (t=0 PIDC) and cyclic stability, low background, and excellent ghosting properties, and which undercoat layer primarily functions to provide for the blocking of holes from the supporting substrate, and excellent cyclic stability for the photoconductor, thus color stability for the xerographic prints generated.

EMBODIMENTS

Aspects of the present disclosure relate to a photoconductor comprising a substrate, and an undercoat layer thereover comprised of a metal oxide, and a mixture of a phenolic resin and a dendritic polyester polyol; a photogenerating layer; and a charge transport layer; a photoconductor comprising a supporting substrate, an undercoat layer thereover comprised of a mixture of a metal oxide, a phenolic polymer, and a dendritic polyester polyol; a photogenerating layer, and a charge transport layer, and wherein the phenolic resin is present in an amount of from about 20 to about 69 weight percent, the dendritic polyester polyol is present in an amount of from about 1 to about 20 weight percent, and wherein the metal oxide is present in an amount of from about 30 to about 70 weight percent, and wherein the total of the components in the undercoat layer is about 100 percent; a photoconductor comprised in sequence of a supporting substrate, a hole blocking layer thereover comprised of a mixture of a metal oxide, a phenolic formaldehyde resin, and a branched polyester polyol; a photogenerating layer, and a hole transport layer; wherein the phenolic formaldehyde resin is selected from the group consisting of the reaction products of p-tert-butylphenol, cresol and formaldehyde; 4,4'-(1-methylethylidene) bisphenol and formaldehyde; phenol, cresol and formaldehyde; phenol, p-tert-butylphenol and formaldehyde; and mixtures thereof; the metal oxide is selected from the group consisting of titanium oxide, titanium dioxide, zinc oxide, tin oxide, aluminum oxide, silicone oxide, zirconium oxide, indium oxide, and molybdenum oxide; the photogenerating layer is comprised of a photogenerating pigment and a resin binder; and the hole transport layer is comprised of aryl amine molecules and a resin binder; a photoconductor comprising a substrate, a ground plane layer, an undercoat layer thereover wherein the undercoat layer comprises a metal oxide dispersed in a mixture of a phenolic resin and a dendritic polyester polyol, a photogenerating layer, and at least one charge transport layer; a photoconductor comprising a substrate, a ground plane layer, an undercoat or hole blocking layer thereover comprised of a metal oxide, a phenolic resin and a dendritic polyester polyol, a photogenerating layer, and a charge transport layer; a rigid drum or flexible belt photoconductor comprising in sequence a supporting substrate, a ground plane layer, a hole blocking layer comprised of metal oxide dispersed in a mixture of a phenolic resin and a dendritic polyester polyol, a photogenerating layer, and a charge transport layer, and wherein the phenolic resin selected for the mixture is commercially available from a number of sources such as OXYCHEM and Great Lakes Chemical Corporation; a photoconductor comprising a supporting substrate, an undercoat layer thereover wherein the undercoat layer comprises a metal oxide, such as a titanium oxide, a zinc oxide, an antimony tin oxide, and other known suitable oxides, dispersed in a mixture of a phenolic resin and a dendritic polyester polyol, and which mixture contains, for example, from 60 to about 99 percent by weight of the phenolic resin and from about 1 to about 40 weight percent of the dendritic polyester polyol, and where the total thereof is about 100 percent, a photogenerating layer, and at least one charge transport layer, where at least one is, for example, from 1 to about 7, from 1 to about 5, from 1 to about 3, 1, or 2 layers; a photoconductor comprising a supporting substrate, an undercoat layer thereover comprised of a mixture of a metal oxide or metal oxides contained in a mixture of a phenolic resin and a dendritic polyester polyol, an adhesive layer, a photogenerating layer, and a charge transport layer; a rigid drum or flexible belt photoconductor comprising in sequence a supporting substrate, such as a nonconductive substrate, thereover an optional ground plane layer; a hole blocking layer comprised of a metal oxide, a phenolic formaldehyde resin and a dendritic polyester polyol, thereover a photogenerating layer, and a charge transport layer; a photoconductive member or device comprising a substrate, a ground plane layer, the undercoat layer illustrated herein, and at least one imaging layer, such as a photogenerating layer and a charge transport layer or layers, formed on the undercoat layer; a photoconductor wherein the photogenerating layer is situated between the charge transport layer and the substrate, and which layer contains a resin binder; an electrophotographic imaging member, which generally comprises at least a substrate layer, a ground plane layer, the undercoat layer illustrated herein, and deposited on the undercoat layer in sequence a photogenerating layer, a charge transport layer, and a protective overcoating layer.

UNDERCOAT LAYER COMPONENT EXAMPLES

Examples of the phenolic resin selected for the hole blocking or undercoat layer may be, for example, dicyclopentadiene type phenolic resins, phenol Novolak resins, cresol Novolak resins, phenol aralkyl resins; and mixtures thereof; polymers generated from formaldehyde, phenol, p-tert-butylphenol, and cresol, such as VARCUM™ 29159, for example 50 weight percent in a 50/50 mixture of xylene/1-butanol, and 29101 (available from OxyChem Company), and DURITE™ 97 (available from Borden Chemical); polymers of formaldehyde with ammonia, cresol, and phenol, such as VARCUM™ 29112 (available from OxyChem Company); polymers of formaldehyde, and 4,4'-(1-methylethylidene)bisphenol, such as VARCUM™ 29108 and 29116 (available from OxyChem Company); polymers of formaldehyde with cresol and phenol, such as VARCUM™ 29457 (available from OxyChem Company); DURITE™ SD-423A, SD-422A (Borden Chemical); polymers of formaldehyde, phenol and p-tert-butylphenol, such as DURITE™ ESD 556C (available from Border Chemical); mixtures thereof, and a number of suitable known phenolic resins.

In embodiments, the phenolic resin or resins that may be selected for the preparation of the undercoat layer, and which resin is present in various effective amounts, such as from about 20 to about 80 weight percent, from about 30 to about 50 weight percent, and more specifically, about 38 weight percent, can be considered to be formed by the reaction condensation product of an aldehyde with a phenol source in the presence of an acidic or basic catalyst. The phenol source may be, for example, phenol; alkyl-substituted phenols, such as cresols and xylenols; halogen-substituted phenols, such as chlorophenol; polyhydric phenols, such as resorcinol or pyrocatechol; polycyclic phenols, such as naphthol and bisphenol A; aryl-substituted phenols, cyclo-alkyl-substituted phenols, aryloxy-substituted phenols, and various mixtures thereof. Examples of a number of specific phenols selected are 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols, such as bisphenol A, and mixtures thereof. In embodiments, there is selected as the phenol reactant a phenol, a p-tert-butylphenol, 4,4'-(1-methylethylidene)bisphenol and cresol.

The aldehyde reactant selected may be, for example, formaldehyde, paraformaldehyde, acetaldehyde, butyraldehyde, paraldehyde, glyoxal, furfuraldehyde, propinonaldehyde, benzaldehyde, mixtures thereof, and a number of other known aldehydes.

In embodiments, the phenolic resins selected are base-catalyzed phenolic resins that are generated with an aldehyde/phenol mole ratio of equal to or greater than one, for example, from about 1 to about 2; or from about 1.2 to about 1.8; or about 1.5. The base catalyst selected in an amount, for example, of from about 0.1 to about 7 weight percent, from about 1 to about 5 weight percent, and about 1 weight percent, for the reaction of the phenol and the aldehyde, such as an amine, is generally miscible with the phenolic resin.

Examples of dendritic polyester polyols selected for the hole blocking layer are generally known and can be obtained from Perstorp Specialty Chemicals (Perstorp, Sweden) as BOLTORN® P500 (OH value of 560 to 630 milligrams KOH/gram, $M_w$ (GPC)=1,800), BOLTORN® P1000 (OH value of 430 to 490 milligrams KOH/grams, $M_w$ (GPC)=1,500), BOLTORN® $H_2O$ (OH value of 490 to 520 milligrams KOH/grams, $M_w$ (GPC)=2,100, $T_g$=25° C.), BOLTORN® H2003 (OH value of 280 to 310 milligrams KOH/grams, $M_w$ (GPC)=2,500, $T_g$=−5° C.), BOLTORN® H2004 (OH value of 110 to 130 milligrams KOH/grams, $M_w$ (GPC)=3,200, $T_g$=−35° C.), BOLTORN® H30 (OH value of 490 to 510 milligrams KOH/grams, $M_w$ (GPC)=3,500, $T_g$=35° C.), BOLTORN® H40 (OH value of 470 to 500 milligrams KOH/grams, $M_w$ (GPC)=5,100, $T_g$=40° C.), BOLTORN® U3000 (OH value of 77 milligrams KOH/grams, $M_w$ (GPC)=6,500), and BOLTORN® W3000 (OH value of 45 milligrams KOH/grams, $M_w$ (GPC)=10,000). In embodiments, a dendritic polyester polyol selected for the hole blocking layer resin mixture layer can be formed by, for example, the polymerization of a core, such as trimethylolpropane and branches extending therefrom of 2,2-dimethylol propionic acid (Bis-MPA), and can be referred to as hydroxyl-functional dendritic polyester polyols.

In embodiments, the dendritic polyester polyol possesses a weight average molecular weight of from about 500 to about 50,000, or from about 1,000 to about 10,000, and a hydroxyl value of from about 30 to about 1,000 milligrams KOH/gram, or from about 200 to about 700 milligrams KOH/gram.

In embodiments, the dendritic polyester polyol is present, for example, in amounts of from about 1 to about 30 weight percent, from about 2 to about 20 weight percent, from 3 to about 15 weight percent, and more specifically, about 12 weight percent based on the weight percentage of the metal oxide, the phenolic resin, and the dendritic polyester polyol.

Various amounts of the phenolic resin can be selected for the undercoat layer. For example, from about 20 to about 70 weight percent, from about 30 to about 50 weight percent, and more specifically, about 28 weight percent of the phenolic resin can be selected, and where the total of the phenolic resin, the metal oxide, and the dendritic polyester polyol amounts to about 100 percent. Throughout, the phrase "from about to about" includes values in between, thus from about 20 to about 80 includes 20, 21, 22, 23, up to 80.

In embodiments, the undercoat layer metal oxide like $TiO_2$ can be either surface treated or untreated. Surface treatments include, but are not limited to, mixing the metal oxide with aluminum laurate, alumina, zirconia, silica, silane, methicone, dimethicone, sodium metaphosphate, and the like, and mixtures thereof. Examples of $TiO_2$ include MT-150W™ (surface treatment with sodium metaphosphate, available from Tayca Corporation), STR-60N™ (no surface treatment, available from Sakai Chemical Industry Co., Ltd.), FTL-100™ (no surface treatment, available from Ishihara Sangyo Laisha, Ltd.), STR-60™ (surface treatment with $Al_2O_3$, available from Sakai Chemical Industry Co., Ltd.), TTO-55N™ (no surface treatment, available from Ishihara Sangyo Laisha, Ltd.), TTO-55A™ (surface treatment with $Al_2O_3$, available from Ishihara Sangyo Laisha, Ltd.), MT-150AW™ (no surface treatment, available from Tayca Corporation), MT-150A™ (no surface treatment, available from Tayca Corporation), MT-100S™ (surface treatment with aluminum laurate and alumina, available from Tayca Corporation), MT-100HD™ (surface treatment with zirconia and alumina, available from Tayca Corporation), MT-100SA™ (surface treatment with silica and alumina, available from Tayca Corporation), and the like.

Examples of metal oxides present in suitable amounts, such as for example, from about 20 to about 80 weight percent, and more specifically, from about 30 to about 70 weight percent, are titanium oxides, and mixtures of metal oxides thereof. In embodiments, the metal oxide has a size diameter of, for example, from about 5 to about 300 nanometers, a powder resistance of from about $1\times10^3$ to about $6\times10^5$ ohm/cm when applied at a pressure of from about 650 to about 50 kilograms/cm$^2$, and yet more specifically, the titanium oxide possesses a primary particle size diameter of from about 10 to about 25 nanometers, and more specifically, from about 12 to about 17 nanometers, and yet more specifically, about 15 nanometers with an estimated aspect ratio of from about 4 to about 5, and is optionally surface treated with, for example, a component containing, for example, from about 1 to about 3 percent by weight of an alkali metal, such as sodium, and a powder resistance of from about $1\times10^4$ to about $6\times10^4$ ohm/cm when applied at a pressure of from about 650 to about 50 kilograms/cm$^2$; MT-150W™, and which titanium oxide is available from Tayca Corporation, and wherein the hole blocking layer is of a suitable thickness, such as a thickness of about from about 0.1 to about 30 microns, thereby avoiding or minimizing charge leakage. Metal oxide examples in addition to titanium, such as titanium dioxide, are chromium, zinc, tin, copper, antimony, and the like, and more specifically, zinc oxide, tin oxide, aluminum oxide, silicone oxide, zirconium oxide, indium oxide, molybdenum oxide, and mixtures thereof.

The hole blocking layer can, in embodiments, be prepared by a number of known methods, the process parameters being dependent, for example, on the photoconductor member desired. The hole blocking layer can be coated as a solution or a dispersion onto the supporting substrate or ground plane layer by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions, or in an air flow. The coating can be accomplished to provide a final coating thickness of from about 0.01 to about 30 microns, from about 0.1 to about 20 microns, from about 1 to about 15 microns, from about 4 to about 8 microns, from about 0.02 to about 0.5 microns, from about 3 to about 15 microns, and more specifically, about 7 microns, after drying at, for example, about 160° C. for a suitable time period, such as from about 15 to about 45 minutes.

PHOTOCONDUCTOR LAYER EXAMPLES

The layers of the photoconductor, in addition to the undercoat layer, can be comprised of a number of known layers, such as supporting substrates, adhesive layers, photogenerating layers, charge transport layers, and protective overcoating top layers, inclusive of the examples of these layers as illustrated in the appropriate copending applications referenced herein.

The thickness of the photoconductive substrate layer depends on a number of factors including economical considerations, electrical characteristics, and the like; thus, this layer may be of a substantial thickness, for example in excess of 3,100 microns, and more specifically, the thickness of the supporting substrate layer is from about 700 to about 2,000 microns, (includes throughout values in between about and about) from about 300 to about 700 microns, or of a minimum thickness of, for example, 70 to about 250 microns. In embodiments, the thickness of the supporting layer is from about 75 to about 275 microns, or from about 95 to about 140 microns.

The substrate may be opaque, substantially transparent, or be of a number of other suitable known forms, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors including strength desired and economical considerations. For a drum, as disclosed in a copending application referenced herein, this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device. In embodiments, where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, substrates selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer, in embodiments, is comprised of, for example, a number of known photogenerating pigments including, for example, Type V hydroxygallium phthalocyanine, Type IV or V titanyl phthalocyanine or chlorogallium phthalocyanine, and a resin binder like poly(vinyl chloride-co-vinyl acetate) copolymer, such as VMCH (available from Dow Chemical), or polycarbonate. Generally, the photogenerating layer can contain known photogenerating pigments, such as metal phthalocyanines, metal free phthalocyanines, alkylhydroxygallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations. The photogenerating layer binder resin is present in various suitable amounts of, for example, from about 1 to about 50 weight percent, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Generally, however, from about 5 to about 90 percent by volume of the photogenerating pigment is dispersed in about 10 to about 95 percent by volume of the resinous binder, or from about 20 to about 30 percent by volume of the photogenerating pigment is dispersed in about 70 to about 80 percent by volume of the resinous binder composition. In one embodiment, about 8 percent by volume of the photogenerating pigment is dispersed in about 92 percent by volume of the resinous binder composition. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicone and compounds of silicone and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones; polycyclic pigments such as dibromo anthanthrone pigments, perylene, and perinone diamines; polynuclear aromatic quinones, azo pigments including bis-, tris- and tetrakis-azos, and the like dispersed in a film forming polymeric binder and fabricated by solvent coating techniques.

Examples of polymeric binder materials that can be selected as the matrix for the photogenerating layer components are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be selected to mix, and thereafter apply the photogenerating layer coating mixture to the substrate, and more specifically, to the hole blocking layer or other layers like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like. The coating of the photogenerating layer on the UCL (undercoat layer) in embodiments of the present disclosure can be accomplished such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. The hole blocking layer or UCL may be applied to the ground plane layer prior to the application of a photogenerating layer.

A suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. As optional adhesive layer usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicone nitride, carbon black, and the like, to provide, for example, in embodiments of the present disclosure, further desirable electrical and optical properties.

A number of charge transport materials, especially known hole transport molecules, and polymers may be selected for the charge transport layer, examples of which are aryl amines of the following formulas/structures, and which layer is generally of a thickness of from about 5 to about 90 microns, and more specifically, of a thickness of from about 10 to about 40 microns

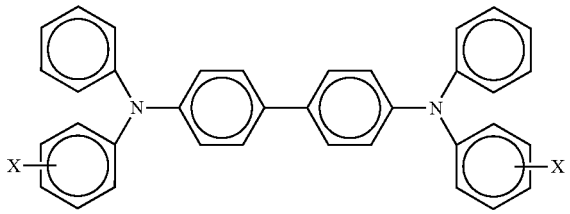

and

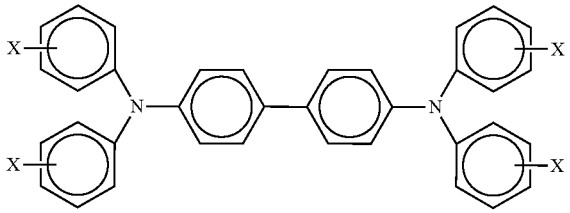

wherein X is a suitable hydrocarbon like alkyl, alkoxy, and aryl, a halogen, or mixtures thereof, and especially those substituents selected from the group consisting of Cl and $CH_3$; and molecules of the following formulas

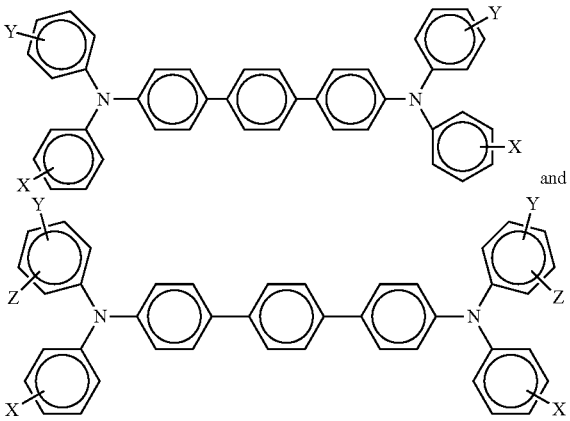

and wherein X, Y and Z are a suitable substituent like a hydrocarbon, such as independently alkyl, alkoxy, or aryl, a halogen, or mixtures thereof. Alkyl and alkoxy contain, for example, from 1 to about 25 carbon atoms, from 1 to about 18 carbon atoms, from 1 to about 12 carbon atoms, and more specifically, from 1 to about 6 carbon atoms and from 1 to about 4 carbon atoms, such as methyl, ethyl, propyl, butyl, pentyl, and the corresponding alkoxides. Aryl can contain from 6 to about 42 carbon atoms, from 6 to about 36 carbon atoms, from 6 to about 24 carbon atoms, from 6 to about 18 carbon atoms, such as phenyl, and the like. Halogen includes chloride, bromide, iodide, and fluoride. Substituted alkyls, alkoxys, and aryls can also be selected in embodiments. At least one charge transport refers, for example, to 1, from 1 to about 7, from 1 to about 4, and from 1 to about 2.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer or layers include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of a polycarbonate resin with, for example, a molecular weight ($M_w$) of from about 20,000 to about 100,000, or with a molecular weight ($M_w$) of from about 50,000 to about 100,000. Generally, the transport layer contains from about 10 to about 75 percent by weight of the charge transport material, and more specifically, from about 35 to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of transporting components and molecules selected for the charge transport layer or layers, and present in various effective amounts include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butyl phenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine; hydrazones such as N-phenyl-N-methyl-3-(9-ethyl) carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material, and a polymeric charge transport material.

In embodiments, the charge transport component can be represented by the following formulas/structures

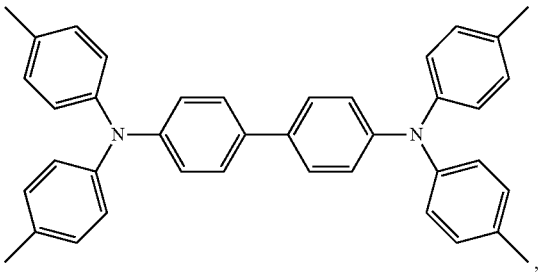

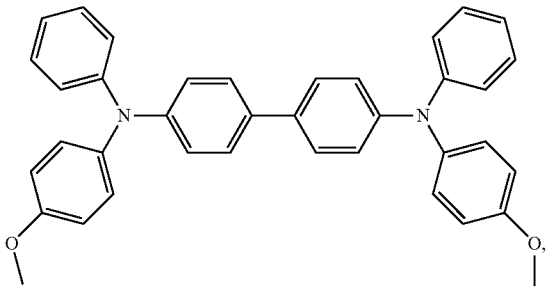

-continued

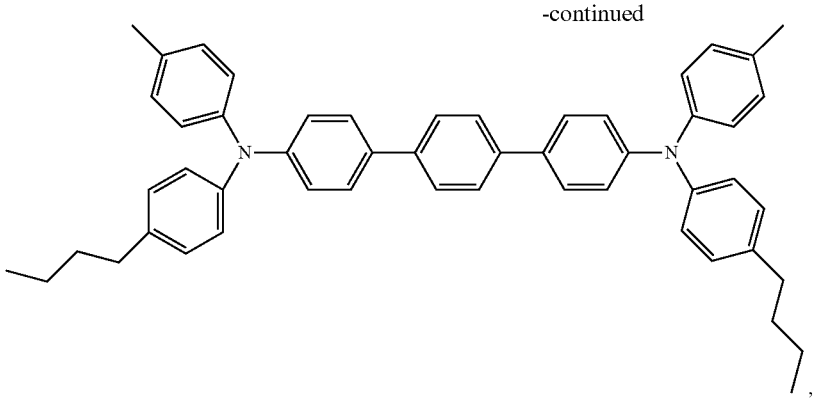

,

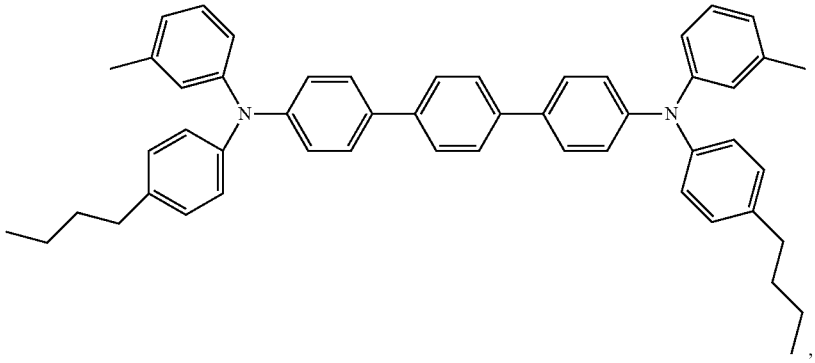

, and

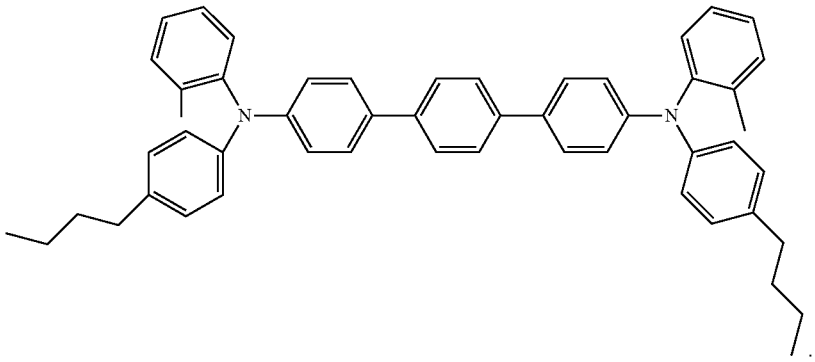

.

Examples of components or materials optionally incorporated into the charge transport layers, or at least one charge transport layer to, for example, assist in lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, and roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 to about 75 microns, from about 15 to about 50 microns, but thicknesses outside these ranges may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer or photogenerating layer, and allows these holes to be transported through itself to selectively discharge a surface charge on the surface of the active layer.

The thickness of the continuous charge transport layer selected depends upon the abrasiveness of the charging (bias charging roll), cleaning (blade or web), development (brush), transfer (bias transfer roll), and the like in the system employed, and can be up to about 10 microns. In embodiments, the thickness for each charge transport layer can be, for example, from about 1 to about 5 microns. Various suitable and conventional methods may be used to mix, and thereafter apply an overcoat top charge transport layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoat layer of this disclosure should transport holes during imaging, and should not have too high a free carrier concentration. Free carrier concentration in the overcoat increases the dark decay. $M_w$, weight average molecular weight, and $M_n$, number average molecular weight were determined by Gel Permeation Chromatography (GPC)

The following Examples are provided. All proportions are by weight unless otherwise indicated.

COMPARATIVE EXAMPLE 1

A hole blocking layer dispersion was prepared by milling 18 grams of $TiO_2$ (MT-150W, manufactured by and obtained from Tayca Co., Japan), and 24 grams of the phenolic resin (VARCUM™ 29159, available from OxyChemical Company, in a solvent mixture of xylene/1-butanol 50/50, weight average molecular weight, $M_w$ of 2,000), and a total solid content of about 48 percent in an attritor mill with about 0.4 to about 0.6 millimeter diameter size $ZrO_2$ beads for 6.5 hours, and then filtering the dispersion with a 20 micron Nylon filter. A 30 millimeter aluminum drum substrate was then coated with the aforementioned generated filtered dispersion using known coating techniques as illustrated herein, and more specifically, by spray coating. After drying at 160° C. for 20 minutes, a hole blocking layer of $TiO_2$ in the phenolic resin ($TiO_2$/phenolic resin ratio of 60/40), about 7 microns in thickness, was obtained.

A photogenerating layer comprising chlorogallium phthalocyanine was deposited on the above hole blocking layer or undercoat layer at a thickness of about 0.2 micron. The photogenerating layer coating dispersion was prepared as follows. 2.7 Grams of chlorogallium phthalocyanine (ClGaPc) Type C pigment were mixed with 2.3 grams of the polymeric binder (carboxyl modified vinyl copolymer, VMCH, Dow Chemical Company), 15 grams of n-butyl acetate, and 30 grams of xylene. The resulting mixture was milled in an attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent, with a ClGaPc Type C/VMCH ratio of 54/46.

Subsequently, a 30 micron thick charge transport layer was coated on top of the photogenerating layer from a dispersion prepared from N,N'-diphenyl-N,N-bis(3-methylphenyl)-1,1'-biphenyl-4,4'-diamine (5.38 grams), a film forming polymer binder, PCZ-400 [poly(4,4'-dihydroxy-diphenyl-1-1-cyclohexane, $M_w$=40,000)] available from Mitsubishi Gas Chemical Company, Ltd. (7.13 grams), and PTFE POLYFLON™ L-2 microparticle (1 gram), available from Daikin Industries, dissolved/dispersed in a solvent mixture of 20 grams of tetrahydrofuran (THF), and 6.7 grams of toluene through a CAVIPRO™ 300 nanomizer (Five Star Technology, Cleveland, Ohio). The charge transport layer was dried at about 120° C. for about 40 minutes.

EXAMPLE I

A photoconductor was prepared by repeating the above process of Comparative Example 1, except that the hole blocking layer dispersion was prepared by milling 18 grams of $TiO_2$ (MT-150W, manufactured by Tayca Co., Japan), 16.8 grams of the phenolic formaldehyde resin VARCUM™ 29159 (obtained from OxyChem Company, about 50 percent in xylene/1-butanol=50/50, $M_w$=2,000), and 3.6 grams of the dendritic polyester polyol, BOLTORN® P1000 (OH value of 430 to 490 milligrams KOH/grams, $M_w$ (GPC)=1,500), obtained from Perstorp Specialty Chemicals, Perstorp, Sweden, in a solvent mixture of xylene and 1-butanol (50/50 mixture), and with a total solid content of about 48 percent in an attritor mill with about 0.4 to about 0.6 millimeter size $ZrO_2$ beads for 6.5 hours, and then filtering with a 20 micron Nylon filter. A 30 millimeter aluminum drum substrate was then coated with the aforementioned generated dispersion using known coating techniques as illustrated herein in Comparative Example 1. After drying at 160° C. for 20 minutes, a hole blocking layer of $TiO_2$ in the above resin mixture ($TiO_2$/phenolic resin/dendritic polyester polyol ratio of 60/28/12), about 7 microns in thickness, was obtained.

EXAMPLE II

A photoconductor is prepared by repeating the above process of Comparative Example 1, except that the hole blocking layer dispersion is prepared by milling 18 grams of $TiO_2$ (MT-150W, manufactured by Tayca Co., Japan), 16.8 grams of the phenolic formaldehyde resin VARCUM™ 29159 (obtained from OxyChem Company, about 50 percent in xylene/1-butanol=50/50, $M_w$=2,000), and 3.6 grams of the dendritic polyester polyol, BOLTORN® $H_2O$ (OH value of 490 to 520 milligrams KOH/grams, $M_w$ (GPC)=2,100, $T_g$=25° C.), obtained from Perstorp Specialty Chemicals, Perstorp, Sweden, in a solvent mixture of xylene and 1-butanol (50/50 mixture), and with a total solid content of about 48 percent in an attritor mill containing about 0.4 to about 0.6 millimeter size $ZrO_2$ beads for 6.5 hours, and then filtering with a 20 micron Nylon filter. A 30 millimeter aluminum drum substrate is then coated in accordance with Comparative Example 1 with the aforementioned generated dispersion. After drying at 160° C. for 20 minutes, a hole blocking layer of $TiO_2$ in the above resin mixture ($TiO_2$/phenolic resin/dendritic polyester polyol ratio of 60/28/12), about 7 microns in thickness, is obtained.

EXAMPLE III

A photoconductor is prepared by repeating the above process of Comparative Example 1, except that the hole blocking layer dispersion is prepared by milling 18 grams of $TiO_2$ (MT-150W, manufactured by Tayca Co., Japan), 16.8 grams of the phenolic formaldehyde resin VARCUM™ 29159 (obtained from OxyChem Company, about 50 percent in xylene/1-butanol=50/50, $M_w$=2,000), and 3.6 grams of the dendritic polyester polyol, BOLTORN® U3000 (OH value of 77 milligrams KOH/grams, $M_w$ (GPC)=6,500), obtained from Perstorp Specialty Chemicals, Perstorp, Sweden, in a solvent mixture of xylene and 1-butanol (50/50 mixture), and with a total solid content of about 48 percent in an attritor mill with about 0.4 to about 0.6 millimeter size $ZrO_2$ beads for 6.5 hours, and then filtering with a 20 micron Nylon filter. A 30 millimeter aluminum drum substrate is then coated in accordance with Comparative Example 1 with the aforementioned generated dispersion. After drying at 160° C. for 20 minutes, a hole blocking layer of $TiO_2$ in the above resin mixture ($TiO_2$/phenolic resin/dendritic polyester polyol ratio 60/28/12), about 7 microns in thickness, is obtained.

ELECTRICAL PROPERTY TESTING

The above prepared photoconductors of Comparative Example 1 and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The two photoconductors were tested at surface potentials of 700 volts with the exposure light intensity incrementally increased by regulating a series of neutral density filters; the exposure light source was a 780 nanometer light emitting diode. The xerographic simulation was completed in an environmentally controlled light tight chamber at dry conditions (10 percent relative humidity and 22° C.).

The above prepared photoconductors exhibited substantially similar PIDCs. Thus, incorporation of the resin mixture of Example I in the hole blocking or undercoat layer did not adversely affect the electrical properties of the photoconductor.

GHOSTING MEASUREMENT

The Comparative Example 1 and Example I photoconductors were acclimated at room temperature for 24 hours before testing in A zone (85° F. and 80 percent humidity) for A zone ghosting. Print testing was accomplished in the Xerox Corporation WorkCentre™ Pro C3545 using the K (black toner) station at t of 500 print counts (t equal to 0 is the first print; t equal to 500 is the $500^{th}$ print), and the CMY stations of the color WorkCentre™ Pro C3545, which operated from t of 0 to t of 500 print counts for the photoconductor, were completed. The prints for determining ghosting characteristics includes an X symbol or letter on a half tone image. When X is invisible, the ghost level is assigned Grade 0; when X is barely visible, the ghost level is assigned Grade 1; Grade 2 to Grade 5 refers to the level of visibility of X with Grade 5 meaning a dark and visible X. Ghosting levels were visually measured against an empirical scale, the smaller the ghosting grade (absolute value), the better the print quality. The ghosting results in A zone are summarized in Table 1.

TABLE 1

| Photoconductors in A Zone | Ghosting Grade at t of 0 | Ghosting Grade at t of 500 prints |
|---|---|---|
| Comparative Example 1, $TiO_2$/Phenolic Resin = 60/40 | Grade -3 | Grade -4 |
| Example I, $TiO_2$/Phenolic Resin/Dendritic Polyester Polyol = 60/28/12 | Grade 0 | Grade -1 |

In A zone and at t=0, the ghosting level for the Example I photoconductor was low and excellent at Grade 0; in contrast, the Comparative Example 1 photoconductor had an elevated poor ghosting level of Grade −3. After 500 prints, the ghosting level for the Example I photoconductor remained low at Grade −1; in contrast, the Comparative Example 1 photoconductor had an elevated ghosting level of Grade −4. The disclosed hole blocking layer comprised of the phenolic resin/dendritic polyester polyol mixture exhibited almost no ghosting or very low ghosting in A zone; in contrast, the Comparative hole blocking layer comprised of the phenolic resin exhibited high ghosting.

Similarly, the Comparative Example 1 and Example I photoconductors were acclimated at room temperature for 24 hours before testing in J zone (75° F. and 10 percent humidity) for J zone ghosting. The ghosting results in J zone are summarized in Table 2.

TABLE 2

| Photoconductors in J Zone | Ghosting Grade at t of 0 | Ghosting Grade at t of 500 prints |
|---|---|---|
| Comparative Example 1, $TiO_2$/Phenolic Resin = 60/40 | Grade -4 | Grade -5 |
| Example I, $TiO_2$/Phenolic Resin/Dendritic Polyester Polyol = 60/28/12 | Grade -1 | Grade -3 |

In J zone and at t=0 (time equals zero), the ghosting level for the Example I photoconductor was an excellent, and improved low at Grade −1; in contrast, the Comparative Example 1 photoconductor had an elevated poor ghosting level of Grade −4. After 500 prints, the ghosting level for the Example I photoconductor remained low at Grade −3; in contrast, the Comparative Example 1 photoconductor had an elevated poor ghosting level of Grade −5. The disclosed hole blocking layer comprised of the phenolic resin/dendritic polyester polyol mixture exhibited low ghosting in J zone; in contrast, the Comparative hole blocking layer comprised of the phenolic resin exhibited high unacceptable ghosting.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting of a substrate, and an undercoat layer thereover consisting of a metal oxide, and a resin mixture of a phenolic resin and a dendritic polyester polyol; a photogenerating layer; and a charge transport layer wherein said phenolic resin is present in said resin mixture in an amount of from about 50 to about 99 weight percent, and said dendritic polyester polyol is present in said resin mixture in an amount of from about 50 to about 1 weight percent, and wherein the total of said phenolic resin and said dendritic polyester polyol is 100 percent in said resin mixture.

2. A photoconductor in accordance with claim 1 wherein said phenolic resin is generated from the condensation product of a phenol and an aldehyde, and wherein said phenol is one of phenol, alkyl-substituted phenols, halogen-substituted phenols, polyhydric phenols, polycyclic phenols, aryl-substituted phenols, cyclo-alkyl-substituted phenols, aryloxy-substituted phenols, and mixtures thereof, and said aldehyde is one of formaldehyde, paraformaldehyde, acetaldehyde, butyraldehyde, paraldehyde, glyoxal, furfuraldehyde, propinonaldehyde, benzaldehyde, and mixtures thereof.

3. A photoconductor in accordance with claim 1 wherein said dendritic polyester polyol is present in an amount of from about 1 to about 30 weight percent based on the components present in said undercoat layer.

4. A photoconductor in accordance with claim 1 wherein said phenolic resin is generated from the reaction of p-tert-butylphenol, cresol and formaldehyde; 4,4'-(1-methylethylidene)bisphenol and formaldehyde; phenol, cresol, and formaldehyde; phenol, p-tert-butylphenol and formaldehyde, and mixtures thereof, and the weight ratio of said phenolic resin to said dendritic polyester polyol in said undercoat layer is from about 50/50 to about 99/1.

5. A photoconductor in accordance with claim 4 wherein the weight ratio is from about 60/40 to about 95/5.

6. A photoconductor in accordance with claim 4 wherein the weight ratio is from about 70/30 to about 90/10.

7. A photoconductor in accordance with claim 1 wherein said metal oxide is dispersed in said phenolic resin and said dendritic polyester polyol mixture.

8. A photoconductor in accordance with claim 1 wherein said dendritic polyester polyol is formed by the polymerization of a core component and 2,2-dimethylol propionic acid, and possesses a weight average molecular weight of from about 500 to about 50,000, and a hydroxyl value of from about 30 to about 1,000 milligrams KOH/gram.

9. A photoconductor in accordance with claim 8 wherein said core is trimethylolpropane, and said dendritic polyester polyol possesses a weight average molecular weight of from about 1,000 to about 10,000, and a hydroxyl value of from about 200 to about 700 milligrams KOH/gram.

10. A photoconductor in accordance with claim 1 wherein said metal oxide is titanium oxide, zinc oxide, tin oxide, aluminum oxide, silicone oxide, zirconium oxide, indium oxide, or molybdenum oxide.

11. A photoconductor in accordance with claim 1 wherein said metal oxide is a titanium dioxide present in an amount of from about 20 to about 80 weight percent based on the weight percent of said undercoat layer components.

12. A photoconductor in accordance with claim 1 wherein said metal oxide is a sodium metaphosphate treated titanium dioxide present in an amount of from about 30 to about 70 weight percent based on the weight percent of said undercoat layer components.

13. A photoconductor in accordance with claim 1 wherein said metal oxide possesses a size diameter of from about 5 to about 300 nanometers, and a powder resistivity of from about $1\times10^3$ to about $1\times10^8$ ohm/cm when applied at a pressure of from about 650 to about 50 kilograms/cm$^2$.

14. A photoconductor in accordance with claim 1 wherein said metal oxide is surface treated with aluminum laurate, alumina, zirconia, silica, silane, methicone, dimethicone, sodium metaphosphate, or mixtures thereof.

15. A photoconductor in accordance with claim 1 wherein the thickness of the undercoat layer is from about 0.01 to about 30 microns.

16. A photoconductor in accordance with claim 1 wherein the thickness of the undercoat layer is from about 1 to about 20 microns, and said metal oxide is titanium dioxide, zinc oxide, or tin oxide.

17. A photoconductor in accordance with claim 1 wherein said charge transport layer consists of at least one of

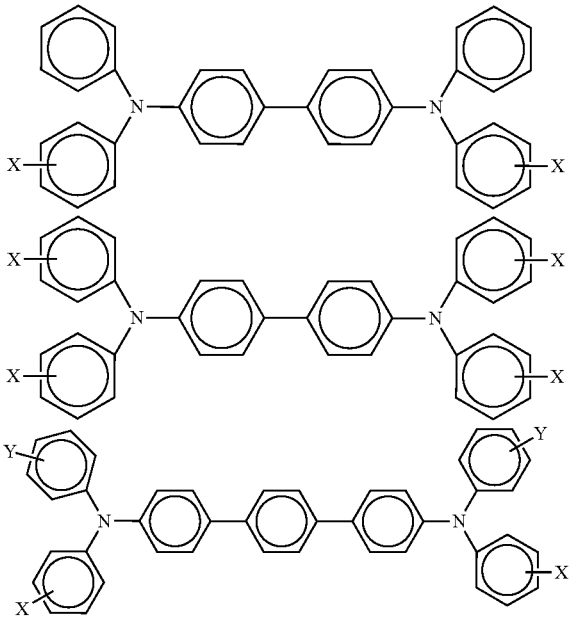

and

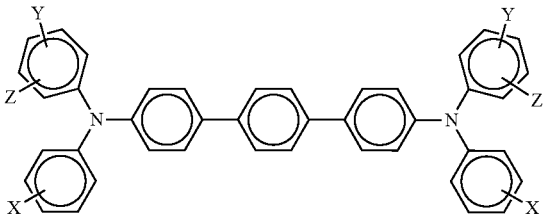

wherein X, Y, and Z are independently selected from the group consisting of alkyl, alkoxy, aryl, halogen, and mixtures thereof.

18. A photoconductor in accordance with claim 1 wherein said charge transport layer consists of a component selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

19. A photoconductor in accordance with claim 1 wherein said photogenerating layer consists of at least one photogenerating pigment.

20. A photoconductor in accordance with claim 19 wherein said photogenerating pigment consists of at least one of a titanyl phthalocyanine, a hydroxygallium phthalocyanine, a halogallium phthalocyanine, a bisperylene, and mixtures thereof.

21. A photoconductor in accordance with claim 1 wherein said charge transport layer consists of a charge transport component and a resin binder, and wherein said photogenerating layer consists of at least one photogenerating pigment and a resin binder; and wherein said photogenerating layer is situated between said substrate and said charge transport layer.

22. A photoconductor in accordance with claim 1 wherein said metal oxide is a titanium oxide or a titanium dioxide, and said dendritic polyester polyol is present in an amount of from 10 to about 30 weight.

23. A photoconductor in accordance with claim 1 wherein said charge transport layer is comprised of 1, 2, or 3 layers.

24. A photoconductor in accordance with claim 1 wherein said metal oxide is titanium dioxide, said phenolic resin is generated from the reaction of p-tert-butylphenol, cresol and formaldehyde; 4,4'-(1-methylethylidene)bisphenol and formaldehyde; phenol, cresol and formaldehyde; phenol, p-tert-butylphenol and formaldehyde, and the weight ratio of said phenolic resin to said dendritic polyester polyol is from about 60/40 to about 99/1.

25. A photoconductor consisting of a supporting substrate, an undercoat layer thereover consisting of a mixture of a metal oxide, a phenolic polymer, and a dendritic polyester polyol; a photogenerating layer, and a charge transport layer, and wherein said phenolic resin is present in an amount of from about 20 to about 69 weight percent, said dendritic polyester polyol is present in an amount of from about 1 to about 20 weight percent, and wherein said metal oxide is present in an amount of from about 30 to about 70 weight percent, and wherein the total of said components in said undercoat layer is about 100 percent, and wherein said dendritic polyester polyol possesses a weight average molecular weight of from about 1,000 to about 3,000, and a hydroxyl value of from about 400 to about 600 milligrams KOH/gram.

26. A photoconductor comprised in sequence of a supporting substrate, a ground plane, a hole blocking layer thereover comprised of a metal oxide, a phenolic formaldehyde resin, and a a dendritic polyester polyol; a photogenerating layer, and a hole transport layer; wherein the phenolic formaldehyde resin is selected from the group consisting of the reaction products of p-tert-butylphenol, cresol and formaldehyde; 4,4'-(1-methylethylidene)bisphenol and formaldehyde; phenol, cresol and formaldehyde; phenol, p-tert-butylphenol and formaldehyde; and mixtures thereof; the metal oxide is selected from the group consisting of titanium oxide, titanium dioxide, zinc oxide, tin oxide, aluminum oxide, silicone oxide, zirconium oxide, indium oxide, and molybdenum oxide; the weight ratio of said phenolic formaldehyde resin and said dendritic polyester polyol is from about 80/20 to about 60/40; the photogenerating layer is comprised of a photogenerating pigment and a resin binder; and the hole transport layer is comprised of aryl amine molecules and a resin binder.

27. A photoconductor in accordance with claim 26 wherein said dendritic polyester polyol formed by the polymerization of trimethylolpropane and 2,2-dimethylol propionic acid, and wherein said photogenerating layer is situated between said substrate and said hole transport layer.

28. A photoconductor in accordance with claim 26 wherein said dendritic polyester polyol possesses a weight average molecular weight of from about 1,000 to about 3,000, and a hydroxyl value of from about 400 to about 600 milligrams KOH/gram, and said phenolic formaldehyde resin is the reaction products of p-tert-butylphenol, cresol and formaldehyde; 4,4'-(1-methylethylidene)bisphenol and formaldehyde; phenol, cresol and formaldehyde; phenol, p-tert-butylphenol and formaldehyde.

29. A photoconductor in accordance with claim 26 wherein said metal oxide is a titanium oxide or a titanium dioxide, and said dendritic polyester polyol is present in an amount of from 10 to about 20 weight percent.

30. A photoconductor in accordance with claim 26 further containing an adhesive layer situated between said ground plane and said photogenerating layer, and wherein said photogenerating layer is situated between said adhesive layer and said charge transport layer, and wherein said charge transport layer is comprised of 1, 2, or 3 layers.

31. A photoconductor in accordance with claim 26 wherein said dendritic polyester polyol is formed by the polymerization of a trialkylolalkyl core and 2,2-dimethylol propionic acid, and which polyol possesses a weight average molecular weight of from about 500 to about 50,000, and a hydroxyl value of from about 30 to about 1,000 milligrams KOH/gram.

* * * * *